US011017648B2

(12) United States Patent
Reyes et al.

(10) Patent No.: US 11,017,648 B2
(45) Date of Patent: May 25, 2021

(54) PEDESTAL WITH EMBEDDED CAMERA(S) FOR BEAM STEERING

(71) Applicants: Neil M. Reyes, Laguna Hills, CA (US); Craig E. Trivelpiece, Mission Viejo, CA (US); Steve E. Trivelpiece, Rancho Santa Margarita, CA (US)

(72) Inventors: Neil M. Reyes, Laguna Hills, CA (US); Craig E. Trivelpiece, Mission Viejo, CA (US); Steve E. Trivelpiece, Rancho Santa Margarita, CA (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

(21) Appl. No.: 16/531,751

(22) Filed: Aug. 5, 2019

(65) Prior Publication Data

US 2020/0043312 A1 Feb. 6, 2020

Related U.S. Application Data

(60) Provisional application No. 62/714,969, filed on Aug. 6, 2018.

(51) Int. Cl.
*G08B 13/24* (2006.01)

(52) U.S. Cl.
CPC ..... *G08B 13/248* (2013.01); *G08B 13/2434* (2013.01); *G08B 13/2448* (2013.01); *G08B 13/2462* (2013.01); *G08B 13/2474* (2013.01)

(58) Field of Classification Search
None
See application file for complete search history.

(56) References Cited

U.S. PATENT DOCUMENTS

| | | | | |
|---|---|---|---|---|
| 7,522,052 | B2 * | 4/2009 | Stobbe | G07C 9/28 340/572.1 |
| 8,786,440 | B2 * | 7/2014 | Clare | G06K 7/0008 340/572.1 |
| 8,847,761 | B1 * | 9/2014 | Claudatos | G06Q 10/087 340/572.1 |
| 9,252,848 | B2 * | 2/2016 | Hale | H04B 5/0062 |
| 9,349,032 | B1 * | 5/2016 | Diorio | G08B 13/2417 |
| 9,519,811 | B1 * | 12/2016 | Simon | G06K 7/10366 |
| 10,140,486 | B1 * | 11/2018 | Lavery | G07G 1/009 |
| 2005/0280504 | A1 * | 12/2005 | Pettus | H01Q 21/062 340/10.1 |

(Continued)

FOREIGN PATENT DOCUMENTS

DE 202015000559 U1 4/2015

*Primary Examiner* — Chico A. Foxx
(74) *Attorney, Agent, or Firm* — Arent Fox, LLP

(57) ABSTRACT

Systems and methods for operating a pedestal of an Electronic Article Surveillance ("EAS") system. The methods comprise: capturing at least one first image or video by a camera coupled to the pedestal; analyzing the at least one first image or video to detect a person's presence and determine the person's location relative to the camera; determining a first beam pointing direction for the pedestal based on results of the analysis of the at least one first image or video; and steering a read beam of the pedestal in accordance with the first beam pointing direction so that a main lobe of the pedestal's antenna field pattern covers a first area of an interrogation zone.

20 Claims, 11 Drawing Sheets

(56) References Cited

U.S. PATENT DOCUMENTS

| | | | | |
|---|---|---|---|---|
| 2006/0072787 | A1* | 4/2006 | Claudatos | G06Q 10/087 382/103 |
| 2007/0252677 | A1* | 11/2007 | Hansen | H04K 3/825 340/10.3 |
| 2010/0065632 | A1* | 3/2010 | Babcock | G06Q 10/087 235/385 |
| 2010/0225480 | A1* | 9/2010 | Bloy | H01Q 3/36 340/572.1 |
| 2011/0080267 | A1 | 4/2011 | Clare et al. | |
| 2012/0307051 | A1* | 12/2012 | Welter | G08B 13/2482 348/143 |
| 2013/0214907 | A1 | 8/2013 | Bloy et al. | |
| 2014/0304123 | A1* | 10/2014 | Schwartz | G06Q 10/087 705/28 |
| 2015/0003627 | A1* | 1/2015 | Andrea | H04R 3/005 381/71.7 |
| 2015/0269818 | A1 | 9/2015 | Jain et al. | |
| 2016/0035197 | A1* | 2/2016 | Soto | G08B 13/2451 340/572.1 |
| 2018/0067204 | A1* | 3/2018 | Frizzell | G01S 13/887 |
| 2018/0284217 | A1* | 10/2018 | Takeuchi | H04B 7/10 |

* cited by examiner

PEDESTAL WITH EMBEDDED CAMERA(S) FOR BEAM STEERING

CROSS REFERENCE TO RELATED APPLICATIONS

This application claims priority to U.S. Provisional Patent Application Ser. No. 62/714,969 entitled "PEDESTAL WITH EMBEDDED CAMERA(S) FOR BEAM STEERING" and filed on Aug. 6, 2018 the contents of which is incorporated herewith in its entirety.

BACKGROUND

Statement of the Technical Field

The present solution relates generally to Electronic Article Surveillance ("EAS") detection systems. More particularly, the present solution relates to pedestals with embedded camera for beam steering.

Description of the Related Art

EAS detection systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS detection system utilizes AcoustoMagnetic ("AM") markers. The general operation of an AM EAS detection system is described in U.S. Pat. Nos. 4,510,489 and 4,510,490, the disclosure of which is herein incorporated by reference. The detection of markers in an AM EAS detection system by pedestals placed at an exit has always been specifically focused on detecting markers only within the spacing of the pedestals. However, the interrogation field generated by the pedestals may extend beyond the intended detection zone. For example, a first pedestal will generally include a main antenna field directed toward a detection zone located between the first pedestal and a second pedestal. When an exciter signal is applied at the first pedestal it will generate an electro-magnetic field of sufficient intensity (or interrogation signal) so as to excite markers (or security tags) within the interrogation or detection zone. Similarly, the second pedestal will generally include an antenna having a main antenna field directed toward the detection zone (and toward the first pedestal). An exciter signal applied at the second pedestal will also generate an electromagnetic field with sufficient intensity (e.g., an interrogation signal) so as to excite markers (or security tags) within the interrogation or detection zone. When a marker tag is excited in the detection zone, it will generate an electromagnetic signal which can usually be detected by receiving the signal at the antennas associated with the first and second pedestal.

One limitation of EAS detection systems is the detection of tagged items in the back-field area behind the pedestal antennas. Tag detection in this area will trigger alarms that are considered false, since the customer carrying the merchandise is not exiting the store. One method used to reduce back-field is to change the antenna's transmit and receive patterns from transceivers (transmit and receive simultaneously) to transmit or receive only. This method is effective in reducing back-field alarms. However, this method reduces the systems performance in the valid detection area. Other methods which compare received amplitudes between multiple antennas have been successful in reducing back-field false alarms. But, these algorithms could be unreliable due to their dependence on noise amplitudes.

Yet another method involves beam steered antennas. Beam steered antennas are dividing their ability to read RFID chips between various zones and always reading as quickly as possible. With the current state of the art, the read rate of RFID chips versus the amount of time to read them before exiting means RFID reads are often missed. When there are no people exiting the pedestal area, the RFID reader continues to use energy and blast RFID RF signals which leads to excessive power and additional RF noise at other reader locations.

SUMMARY

The present disclosure concerns implementing systems and methods for operating a pedestal of an EAS system. The methods comprise: capturing at least one first image or video by a camera coupled to the pedestal; analyzing the at least one first image or video to detect a person's presence and determine the person's location relative to the camera; determining, by a system controller for the pedestal, a first beam pointing direction for the pedestal based on results of the analysis of the at least one first image or video; and steering, by the system controller, a read beam of the pedestal in accordance with the first beam pointing direction so that a main lobe of the pedestal's antenna field pattern covers a first area of an interrogation zone.

The methods may further comprise: causing the pedestal to transmit an interrogation signal in a direction away from the pedestal and into the first area; and/or receiving, by the pedestal, a response signal that causes an active security tag detection by the EAS system.

In some scenarios, the analyzing further involves determining environmental conditions in an area of a facility at least partially surrounding the pedestal. The pedestal may be caused to transmit an interrogation signal into the first area and at a time determined based on the environmental conditions. The environmental condition includes, but is not limited to, door movement.

In those or other scenarios, the methods further comprise: capturing at least one second image or video by the camera or another camera coupled to the pedestal; analyzing the at least one second image or video to detect the person's presence and determine the person's location relative to the camera or another camera; determining a second beam pointing direction for the pedestal based on results of the analysis of the at least one second image or video, where the second beam pointing direction is different than the first beam pointing direction; and steering the read beam of the pedestal in accordance with the second beam pointing direction so that the main lobe of the pedestal's antenna field pattern covers a second area different than the first area of the interrogation zone.

In those or other scenarios, the methods further comprise: determining a second beam pointing direction for the pedestal based on content of at least one first image or video; and re-steering the read beam of the pedestal in accordance with the second beam pointing direction so that the main lobe of the pedestal's antenna field pattern covers a second area of an interrogation zone.

In those or other scenarios, the methods further comprise: using camera data to track movement of the person; and dynamically steering the read beam to follow the person through the interrogation zone. The camera may be embedded into an antenna or the pedestal.

The implementing systems comprise: a pedestal; a camera coupled to the pedestal; and a system controller communicatively connected to the pedestal and the camera. The camera is configured to capture at least one first image or video, and/or analyze the at least one first image or video to detect a person's presence and determine the person's location relative to the camera. The system controller comprises a processor and a non-transitory computer-readable storage medium comprising programming instructions that are configured to cause the processor to: determine a first beam pointing direction for the pedestal based on results of the analysis of the at least one first image or video; and cause a read beam of the pedestal to be steered in accordance with the first beam pointing direction so that a main lobe of the pedestal's antenna field pattern covers a first area of an interrogation zone.

The pedestal may: be caused to transmit an interrogation signal in a direction away from the pedestal and into the first area; and/or receive a response signal that causes an active security tag detection by the EAS system.

In some scenarios, the analysis of the at least one first image or video comprises determining environmental conditions in an area of a facility at least partially surrounding the pedestal. The pedestal is caused to transmit an interrogation signal into the first area and at a time determined based on the environmental conditions. The environmental condition includes, but is not limited to, door movement.

In those or other scenarios, the camera or another camera coupled to the pedestal captures at least one second image or video, and/or analyze the at least one second image or video to detect the person's presence and determine the person's location relative to the camera or another camera. The programming instructions further cause the processor to: determine a second beam pointing direction for the pedestal based on results of the analysis of the at least one second image or video, where the second beam pointing direction is different than the first beam pointing direction; and cause the read beam of the pedestal to be steered in accordance with the second beam pointing direction so that the main lobe of the pedestal's antenna field pattern covers a second area different than the first area of the interrogation zone.

In those or other scenarios, the programming instructions further cause the processor to: determine a second beam pointing direction for the pedestal based on content of at least one first image or video; and cause the read beam of the pedestal to be re-steered in accordance with the second beam pointing direction so that the main lobe of the pedestal's antenna field pattern covers a second area of an interrogation zone. Additionally or alternatively, the programming instructions further cause the processor to: use camera data to track movement of the person; and cause the read beam to be dynamically steered to follow the person through the interrogation zone. The camera may be embedded into an antenna or the pedestal.

BRIEF DESCRIPTION OF THE DRAWINGS

The present solution will be described with reference to the following drawing figures, in which like numerals represent like items throughout the figures.

DETAILED DESCRIPTION

Figure 1:
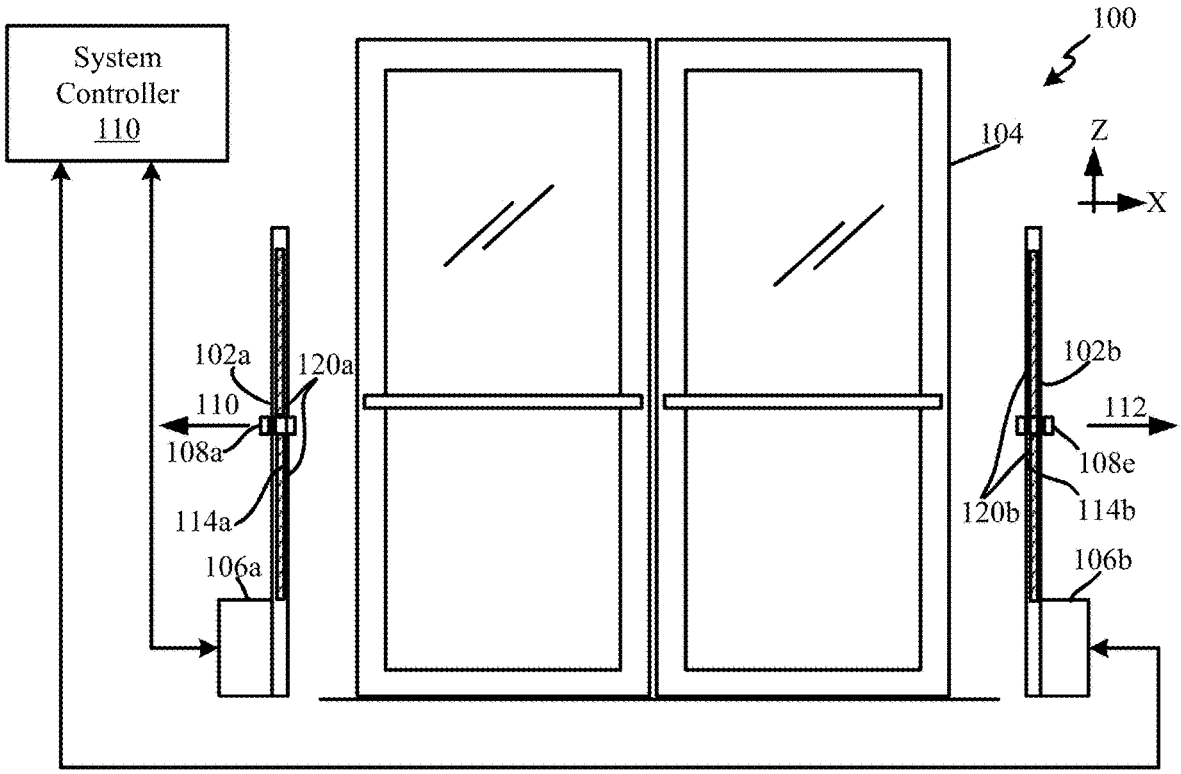
FIG. 1 is a side view of an illustrative EAS detection system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The terms "memory," "memory device," "data store," "data storage facility" and the like each refer to a non-transitory device on which computer-readable data, programming instructions (e.g., instructions 1060 of FIG. 10) or both are stored. Except where specifically stated otherwise, the terms "memory," "memory device," "data store," "data storage facility" and the like are intended to include single device embodiments, embodiments in which multiple memory devices together or collectively store a set of data or instructions, as well as individual sectors within such devices.

The terms "processor" and "processing device" refer to a hardware component of an electronic device that is configured to execute programming instructions. Except where specifically stated otherwise, the singular term "processor" or "processing device" is intended to include both single-processing device embodiments and embodiments in which multiple processing devices together or collectively perform a process.

The present solution provides pedestals employing beam steered antennas for reading active security tags in a variable interrogation zone. RF reflections from doors and people can interfere with optimal reading in some environments so the ability to detect people entering or door motion can be used to further improve reliability in crowded RF store environments. In this regard, the present solution uses one or more cameras with Artificial Intelligence ("AI") for detecting people and objects in an area adjacent to the pedestals. The cameras facilitate optimization of the read zones for the tag readers, while reducing power usage, RF interference and false positives. The beam steered antennas can now be controlled to optimize reading in only those zones with people moving towards or through exits or areas of interest.

Accordingly, the present disclosure concerns implementing systems and methods for operating a pedestal of an EAS system. The methods comprise: capturing at least one first image or video by a camera coupled to the pedestal; analyzing the at least one first image or video to detect a person's presence and determine the person's location relative to the camera; determining, by a system controller for the pedestal, a first beam pointing direction for the pedestal based on results of the analysis of the at least one first image or video; and steering, by the system controller, a read beam of the pedestal in accordance with the first beam pointing direction so that a main lobe of the pedestal's antenna field pattern covers a first area of an interrogation zone.

The methods may further comprise: causing the pedestal to transmit an interrogation signal in a direction away from the pedestal and into the first area; and/or receiving, by the pedestal, a response signal that causes an active security tag detection by the EAS system.

In some scenarios, the analyzing further involves determining environmental conditions in an area of a facility at least partially surrounding the pedestal. The pedestal may be caused to transmit an interrogation signal into the first area and at a time determined based on the environmental conditions. The environmental condition includes, but is not limited to, door movement.

In those or other scenarios, the methods further comprise: capturing at least one second image or video by the camera or another camera coupled to the pedestal; analyzing the at least one second image or video to detect the person's presence and determine the person's location relative to the camera or another camera; determining a second beam pointing direction for the pedestal based on results of the analysis of the at least one second image or video, where the second beam pointing direction is different than the first beam pointing direction; and steering the read beam of the pedestal in accordance with the second beam pointing direction so that the main lobe of the pedestal's antenna field pattern covers a second area different than the first area of the interrogation zone.

Additionally or alternatively, the methods further comprise: determining a second beam pointing direction for the pedestal based on content of at least one first image or video; and re-steering the read beam of the pedestal in accordance with the second beam pointing direction so that the main lobe of the pedestal's antenna field pattern covers a second area of an interrogation zone.

Additionally or alternatively, the methods further comprise: using camera data to track movement of the person; and dynamically steering the read beam to follow the person through the interrogation zone. The camera may be embedded into an antenna or the pedestal.

The implementing systems comprise: a pedestal; a camera coupled to the pedestal; and a system controller communicatively connected to the pedestal and the camera. The camera is configured to capture at least one first image or video, and/or analyze the at least one first image or video to detect a person's presence and determine the person's location relative to the camera. The system controller comprises a processor and a non-transitory computer-readable storage medium comprising programming instructions that are configured to cause the processor to: determine a first beam pointing direction for the pedestal based on results of the analysis of the at least one first image or video; and cause a read beam of the pedestal to be steered in accordance with the first beam pointing direction so that a main lobe of the pedestal's antenna field pattern covers a first area of an interrogation zone. The pedestal may: be caused to transmit an interrogation signal in a direction away from the pedestal and into the first area; and/or receive a response signal that causes an active security tag detection by the EAS system.

In some scenarios, the analysis of the at least one first image or video comprises determining environmental conditions in an area of a facility at least partially surrounding the pedestal. The pedestal is caused to transmit an interrogation signal into the first area and at a time determined based on the environmental conditions. The environmental condition includes, but is not limited to, door movement.

In those or other scenarios, the camera or another camera coupled to the pedestal captures at least one second image or video. The programming instructions further cause the processor to: analyze the at least one second image or video to detect the person's presence and determine the person's location relative to the camera or another camera; determine a second beam pointing direction for the pedestal based on results of the analysis of the at least one second image or video, where the second beam pointing direction is different than the first beam pointing direction; and cause the read beam of the pedestal to be steered in accordance with the second beam pointing direction so that the main lobe of the pedestal's antenna field pattern covers a second area different than the first area of the interrogation zone.

In those or other scenarios, the programming instructions further cause the processor to: determine a second beam pointing direction for the pedestal based on content of at least one first image or video; and cause the read beam of the pedestal to be re-steered in accordance with the second beam pointing direction so that the main lobe of the pedestal's antenna field pattern covers a second area of an interrogation zone. Additionally or alternatively, the programming instructions further cause the processor to: use camera data to track movement of the person; and cause the read beam to be dynamically steered to follow the person through the interrogation zone. The camera may be embedded into an antenna or the pedestal.

Illustrative System Architecture

Figure 2:
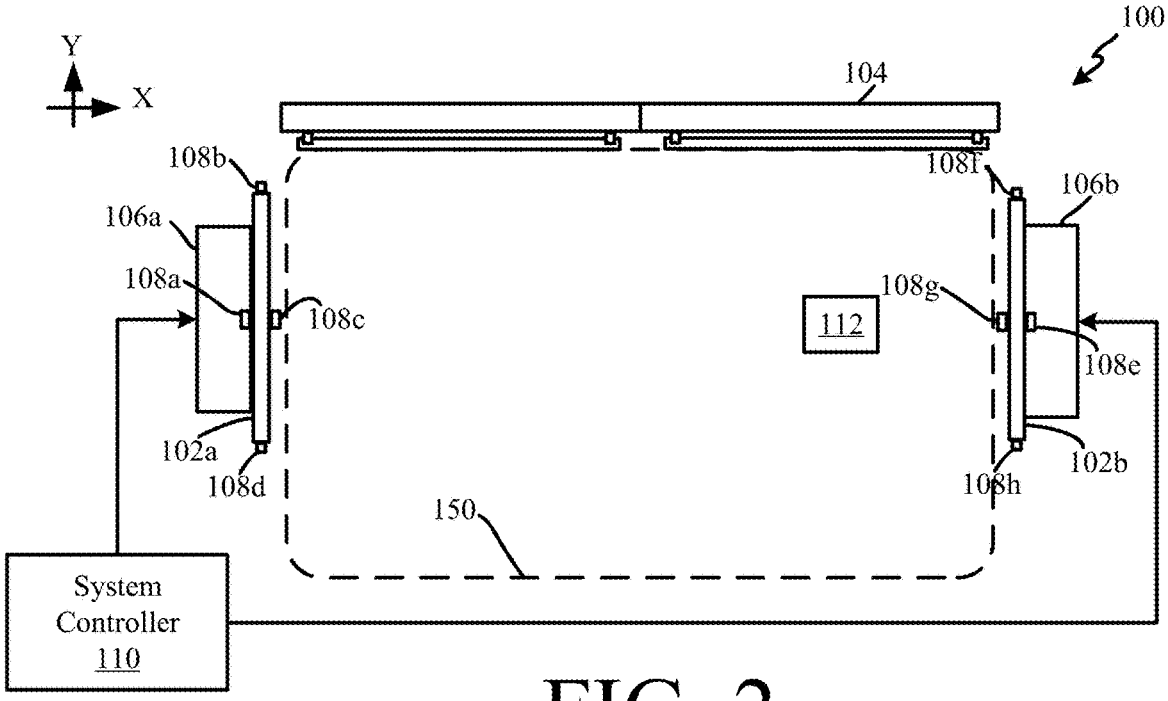
FIG. 2 is a top view of the EAS detection system in FIG. 1, which is useful for understanding an EAS detection zone thereof.

Referring now to FIGS. 1 and 2, an illustrative architecture for an EAS detection system 100 is provided. Notably, the present solution is described herein in terms of a Radio Frequency Identification ("RFID") EAS detection systems. However, the methods of the present solution can also be used in other types of EAS detection systems, including systems that use AM type tags and AM EAS detection systems.

The EAS detection system 100 will be positioned at a location adjacent to an entry/exit 104 of a secured facility (e.g., a retail store). The EAS detection system 100 uses specially designed EAS marker tags ("security tags") which are applied to store merchandise or other items which are stored within a secured facility. Security tags are well known in the art, and therefore will not be described herein in detail. Any known or to be known security tag can be used herein without limitation. The security tags can be deactivated or removed by authorized personnel at the secure facility. For example, in a retail environment, the security tags could be removed by store employees.

When an active security tag 112 is detected by the EAS detection system 100 in an idealized representation of an EAS detection zone (or interrogation zone) 150 near the entry/exit, the EAS detection system will detect the presence of such security tag and will sound an alarm or generate some other suitable EAS response. Accordingly, the EAS detection system 100 is arranged for detecting and preventing the unauthorized removal of articles or products from controlled areas.

The EAS detection system 100 includes a pair of pedestals 102*a*, 102*b*, which are located a known distance apart (e.g., at opposing sides of an entry/exit 104). The pedestals 102*a*, 102*b* are typically stabilized and supported by a base 106*a*, 106*b*. The pedestals 102*a*, 102*b* will each generally include one or more antennas that are suitable for aiding in the detection of the special EAS security tags, as described herein. For example, pedestal 102*a* can include at least one antenna 120*a* suitable for transmitting or producing an RF exciter signal (or interrogation signal) and receiving response signals generated by active security tags in the EAS detection zone 150. In some scenarios, the same antenna can be used for both receive and transmit functions. Similarly, pedestal 102*b* can include at least one antenna 120*b* suitable for transmitting or producing an RF exciter signal (or interrogation signal) and receiving response signals generated by security tags in the EAS detection zone 150.

The antennas provided in pedestals 102*a*, 102*b* include, but are not limited to, beam-steering antennas. Beam-steering antennas are well known in the art, and therefore will not be described herein. Any known or to be known beam-steering antenna can be used herein without limitation. In system 100, the direction of the antenna's beam can be changed in a controlled manner based on contextual information about a surrounding environment. The manner in which the antenna's beam direction is controlled will become evident as the discussion progresses.

In some scenarios, a single antenna can be used in each pedestal. The single antenna is selectively coupled to the EAS receiver. The EAS transmitter is operated in a time multiplexed manner. However, it can be advantageous to include two antennas in each pedestal as shown in FIG. 1, with an upper antenna positioned above a lower antenna.

The antennas located in the pedestals 102*a*, 102*b* are electrically coupled to a system controller 110. The system controller 110 controls the operation of the EAS detection system 100 to perform EAS functions as described herein. The system controller 110 can be located within a base 106*a*, 106*b* of one of the pedestals 102*a*, 102*b* or can be located within a separate chassis at a location nearby to the pedestals. For example, the system controller 110 can be located in a ceiling just above or adjacent to the pedestals 102*a*, 102*b*.

As noted above, the EAS detection system comprises an RFID type EAS detection system. As such, each antenna is used to generate an RFID signal which serves as an interrogation signal. The interrogation signal causes the security tag 112 to generate and transmit an RFID response signal. This RFID response signal is used to indicate a presence of the security tag 112 within the EAS detection zone (or interrogation zone) 150. As noted above, the same antenna contained in a pedestal 102*a*, 102*b* can serve as both the transmit antenna and the receive antenna.

Figure 3:
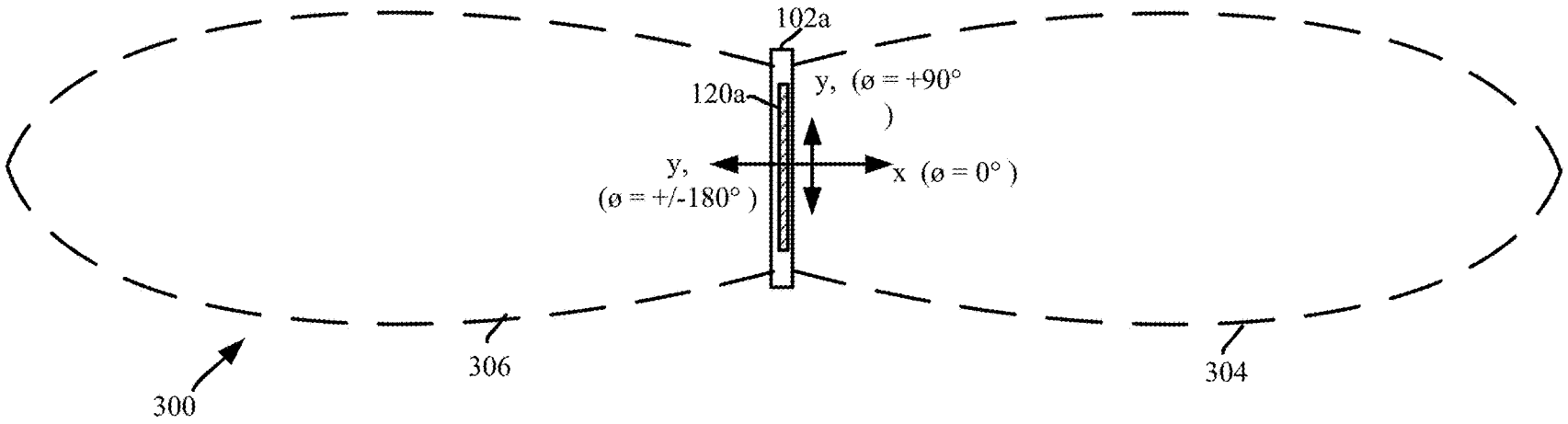
FIGS. 3 and 4 are drawings which are useful for understanding a main field and a back-field of antennas which are used in the EAS detection system of FIG. 1.
Figure 4:
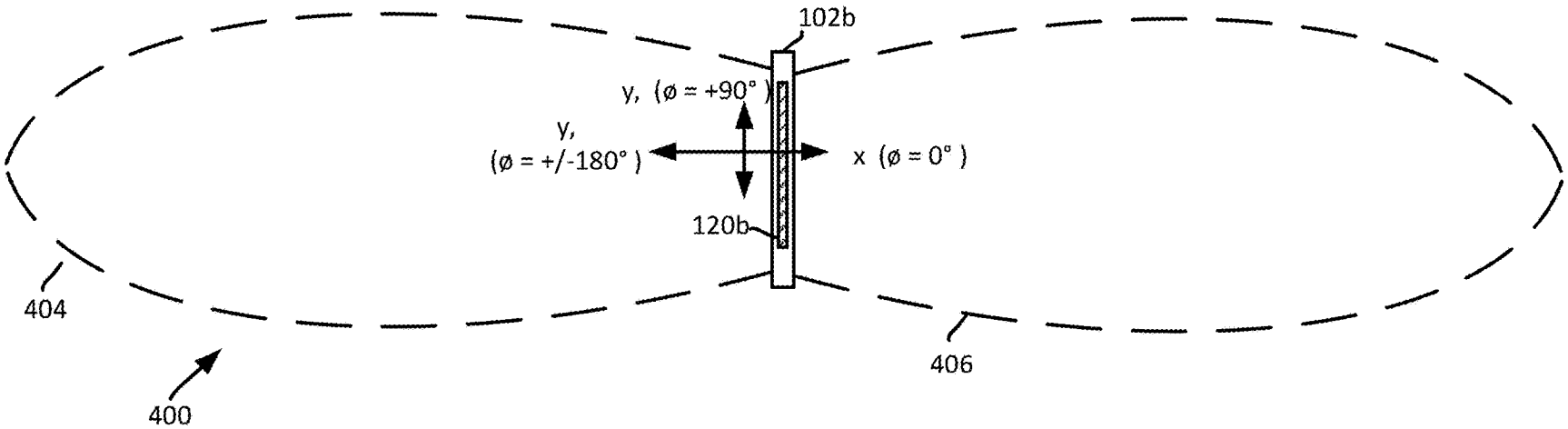

Referring now to FIGS. 3 and 4, there are shown illustrative antenna patterns 300, 400 for antennas 120*a*, 120*b* contained in pedestals 102*a*, 102*b*. As is known in the art, an antenna radiation pattern is a graphical representation of the radiating (or receiving) properties for a given antenna as a function of space. The properties of an antenna are the same in a transmit mode and a receive mode of operation. As such, the antenna radiation pattern shown is applicable for both transmit and receive operations as described herein. The illustrative antenna field patterns 300, 400 shown in FIGS. 3-4 are azimuth plane patterns representing the antenna pattern in the x, y coordinate plane. The azimuth pattern is represented in polar coordinate form and is sufficient for understanding the inventive arrangements. The azimuth antenna field patterns shown in FIGS. 3-4 are a useful way of visualizing the direction in which the antennas 302, 402 will transmit and receive signals at a particular transmitter power level.

Figure 5:
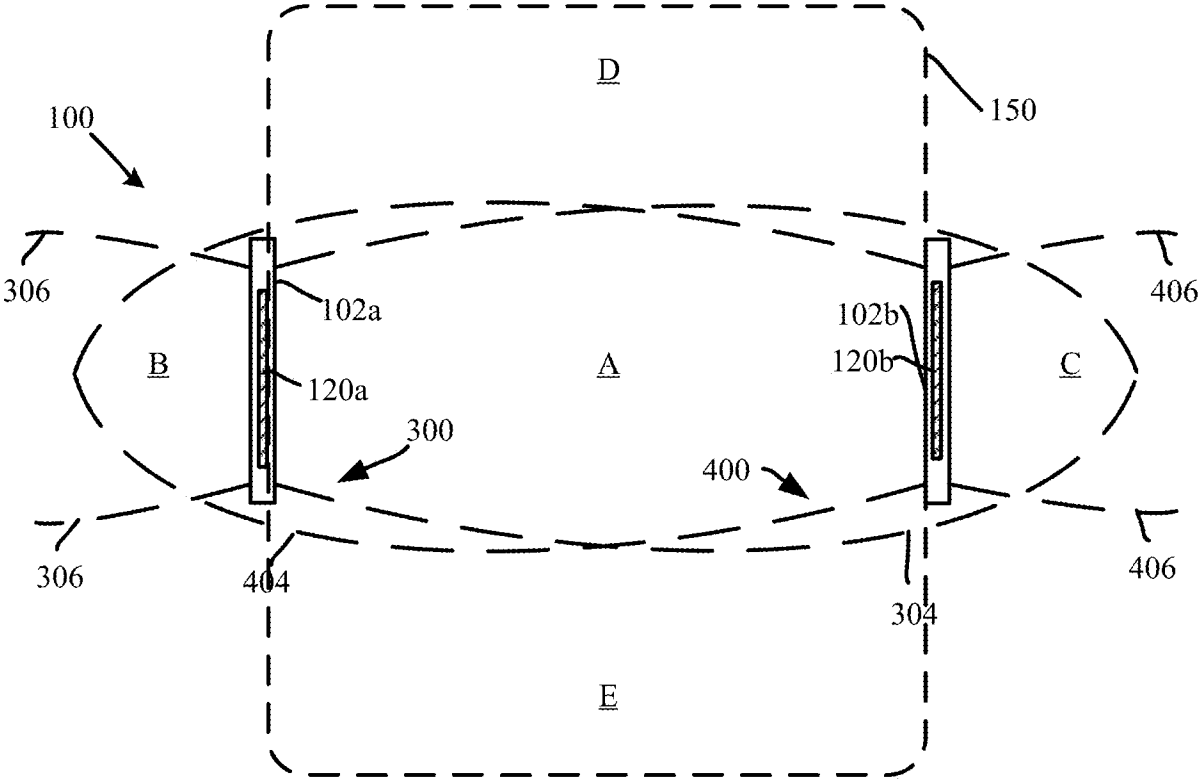
FIGS. 5-8 each provide a drawing which is useful for understanding a variable detection zone in the EAS detection system of FIG. 1.

The antenna field pattern 300 shown in FIG. 3 includes a main lobe 304 with a peak at =0° and a back-field lobe 306 with a peak at angle =180°. Conversely, the antenna field pattern 400 shown in FIG. 4 includes a main lobe 404 with its peak at =180° and a back-field lobe 406 with a peak at angle =0°. In the EAS detection system 100, each pedestal 102*a*, 102*b* is positioned so that the main lobe of an antenna contained therein is directed into the EAS detection zone (or interrogation zone) 150. Accordingly, a pair of pedestals 102*a*, 102*b* in the EAS detection system 100 will produce overlap in the antenna field patterns 300, 400, as shown in FIG. 5. Notably, the antenna field patterns 300, 400 shown in FIG. 5 are scaled for purposes of understanding the present solution. In particular, the patterns show the outer boundary or limits of an area in which an exciter signal of particular amplitude applied to antennas 102*a*, 102*b* will produce a detectable response in an EAS security tag.

However, it should be understood that a security tag within the bounds of at least one antenna field pattern 300, 400 will generate a detectable response when stimulated by an exciter signal.

The overlapping antenna field patterns 300, 400 in FIG. 5 will include an area A where there is overlap of main lobes 304, 404. However, it can be observed in FIG. 5 that there can also be some overlap of a main lobe of each pedestal with a back-field lobe associated with the other pedestal. For example, it can be observed that the main lobe 404 overlaps with the back-field lobe 306 within an area B. Similarly, the main lobe 304 overlaps with the back-field lobe 306 in an area C. Area A between pedestals 102*a*, 102*b* defines at least a portion of the EAS detection zone 150 in which active security tags should cause the EAS detection system 100 to generate an alarm response. Security tags in area A are stimulated by energy associated with an exciter signal within the main lobes 304, 404 and will produce a response which can be detected at each antenna. The response produced by a security tag in area A is detected within the main lobes of each antenna and processed in the system controller 110. Notably, a security tag in areas B or C will also be excited by the antennas 102*a*, 102*b*. The response signal produced by a security tag in these areas B and C will also be received at one or both antennas. This response signal is referred to herein as a "security tag signal".

Referring again to FIGS. 1-2, at least one camera 108*a*, 108*b*, 108*c*, 108*d*, 108*e*, 108*f*, 108*g*, 108*h* is advantageously mounted on each pedestal 102*a* or 102*b*. Cameras are well known in the art, and therefore will not be described herein. Any known or to be known camera can be used herein without limitation. For example, camera chips with embedded Artificial Intelligence ("AI") are employed in system 100. The camera chips can include, but are not limited to, a smart camera with embedded AI available from Horizon Robotics of Beijing, China. Generally, each camera 108*a*-108*h* is configured to: locate and track people, packages, objects and environmental conditions (e.g., door motion, the presence of a shopping cart, the presence of a restocking cart, the presence of a pallet of item, and/or the presence of another metal or glass item) in an area around the respective pedestal; and capture images of the area around the respective pedestal. Metadata is generated by the camera that indicates (1) the presence of a detected person/package/object, (2) a location of the detected person/package/object, and/or (3) environmental conditions (e.g., motion of door 104). The term "metadata", as used herein, refers to a set of data that describes or given information about other data (e.g., about the contents of images and/or videos). This metadata can be communicated to the system controller 110 for use in steering antenna beams. The cameras can also capture images. These images may or may not be communicated to the system controller 110 in addition to the metadata depending on a given application.

The area covered by the camera can include areas A, B, C, D or E shown in FIG. 5. Notably, the cameras are not shown in FIG. 5 for simplicity of illustration. For example, camera 108*a* is disposed on the back of pedestal 102*a* so that it covers area B. Similarly, camera 108*e* is disposed on the back of pedestal 102*b* so that it covers area C. Each camera 108*b*, 108*f* is disposed on a first side of a respective pedestal 102*a*, 102*b* so that it covers area D defining a portion of the interrogation zone 150. Each camera 108*c*, 108*g* is disposed on a front of a respective pedestal 102*a*, 102*b* so that it covers area A defining a portion of the interrogation zone 150. Each camera 108*d*, 108*h* is disposed on a second side of a respective pedestal 102*a*, 102*b* so that it covers area E defining a portion of the interrogation zone 150.

Each camera 108*a*-108*h* is shown in FIG. 1 as being located in the middle of the vertically elongate pedestals. The presents solution is not limited in this regard. Each camera can be located at any location on the respective pedestal in accordance with a given application. For example, each camera 108*a*, 108*c*, 108*g*, 108*e* is located at the top center of the pedestal. Additionally, any number of cameras can be provided with each pedestal. The total number of cameras on each pedestal is selected in accordance with a given application.

One or more of the cameras can be embedded into a respective antenna or pedestal. The camera(s) are controlled and provided power from the RFID reader or system controller 110. 1-wire technology may be employed to provide data, power and RF. In some scenarios, the camera(s) use less than 1 mW continuous and the data rate of the metadata is low enough to be supported by 1-wire technology. So, one or more cameras may be added to a 1-wire bus of system 100 for easy integration with an RFID reader.

Figure 6:
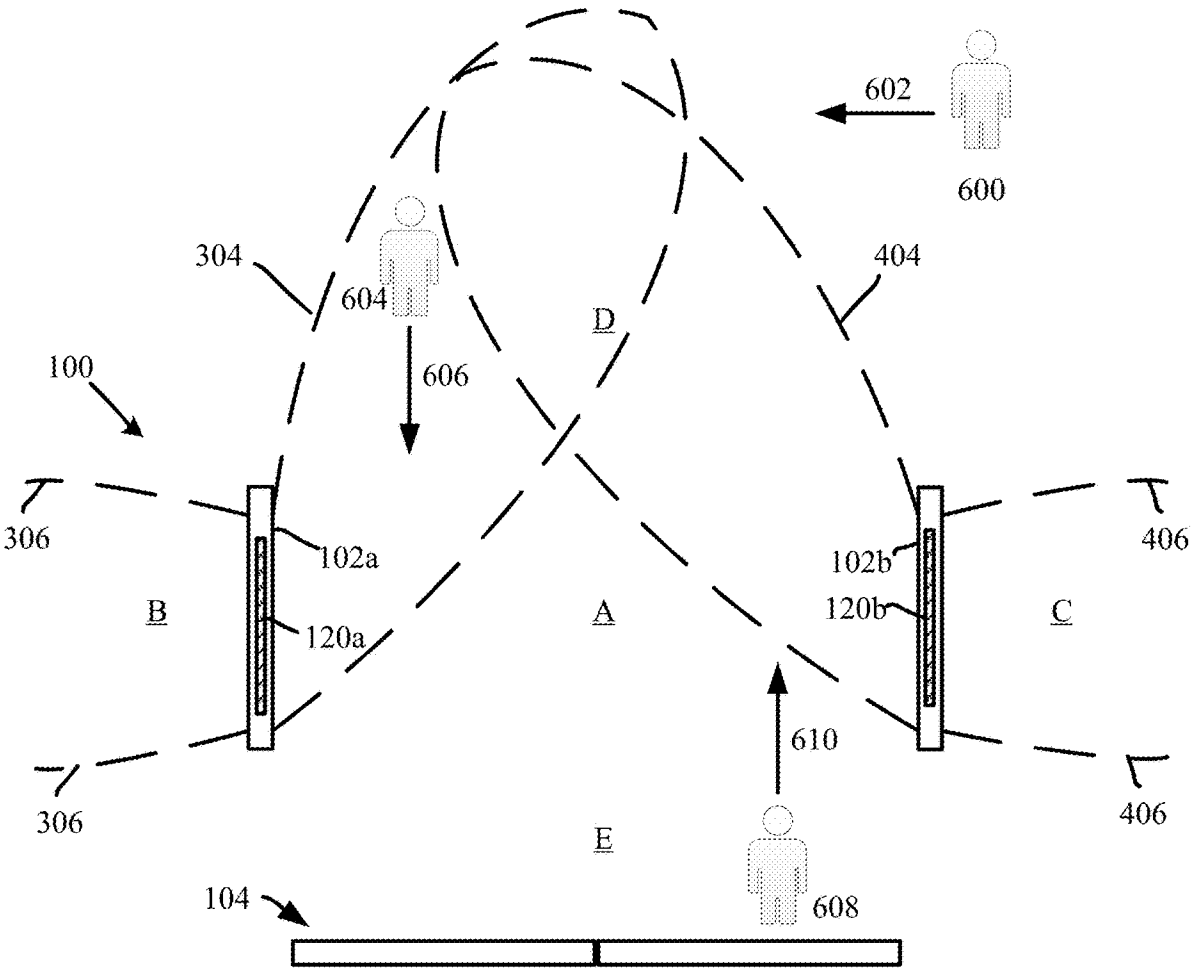
Figure 7:
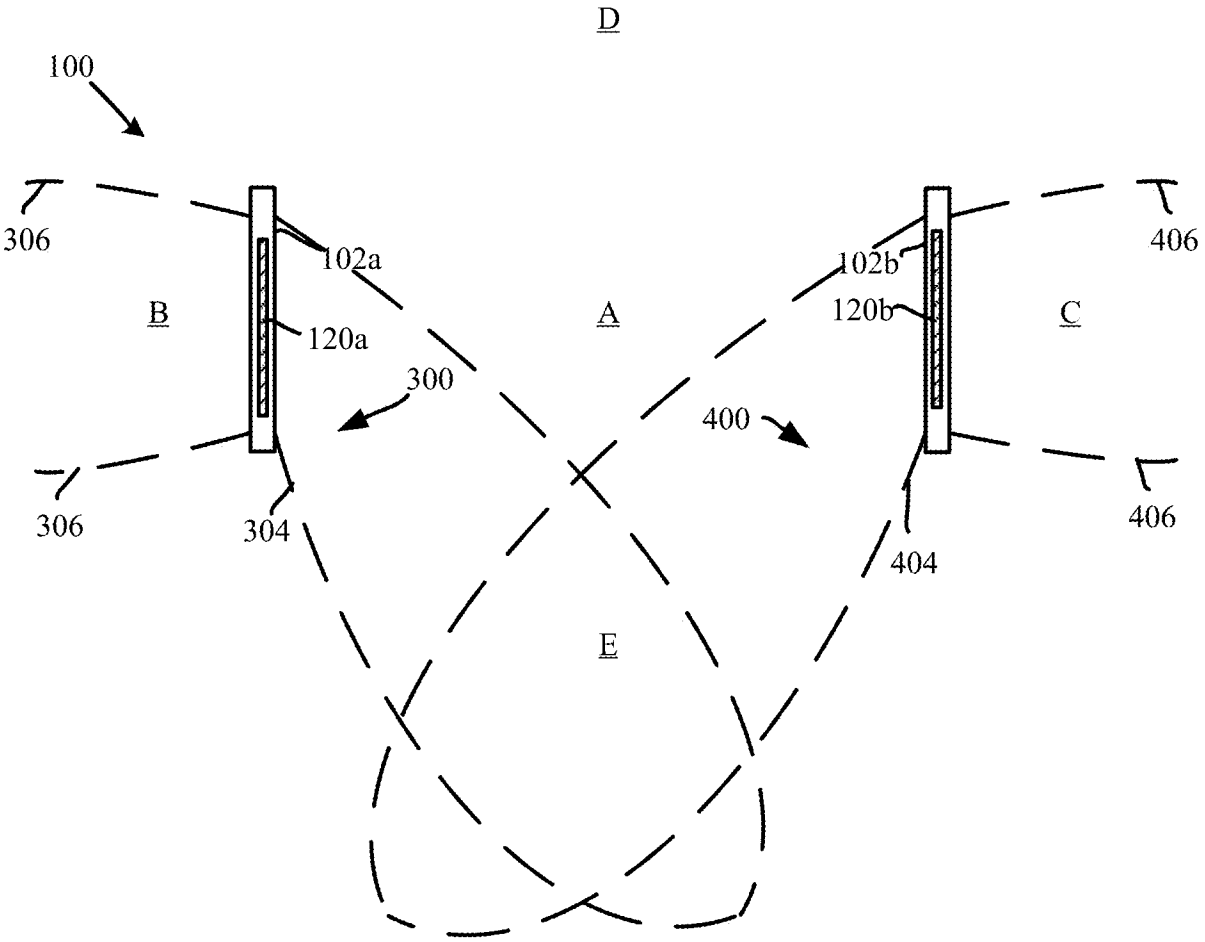
Figure 8:
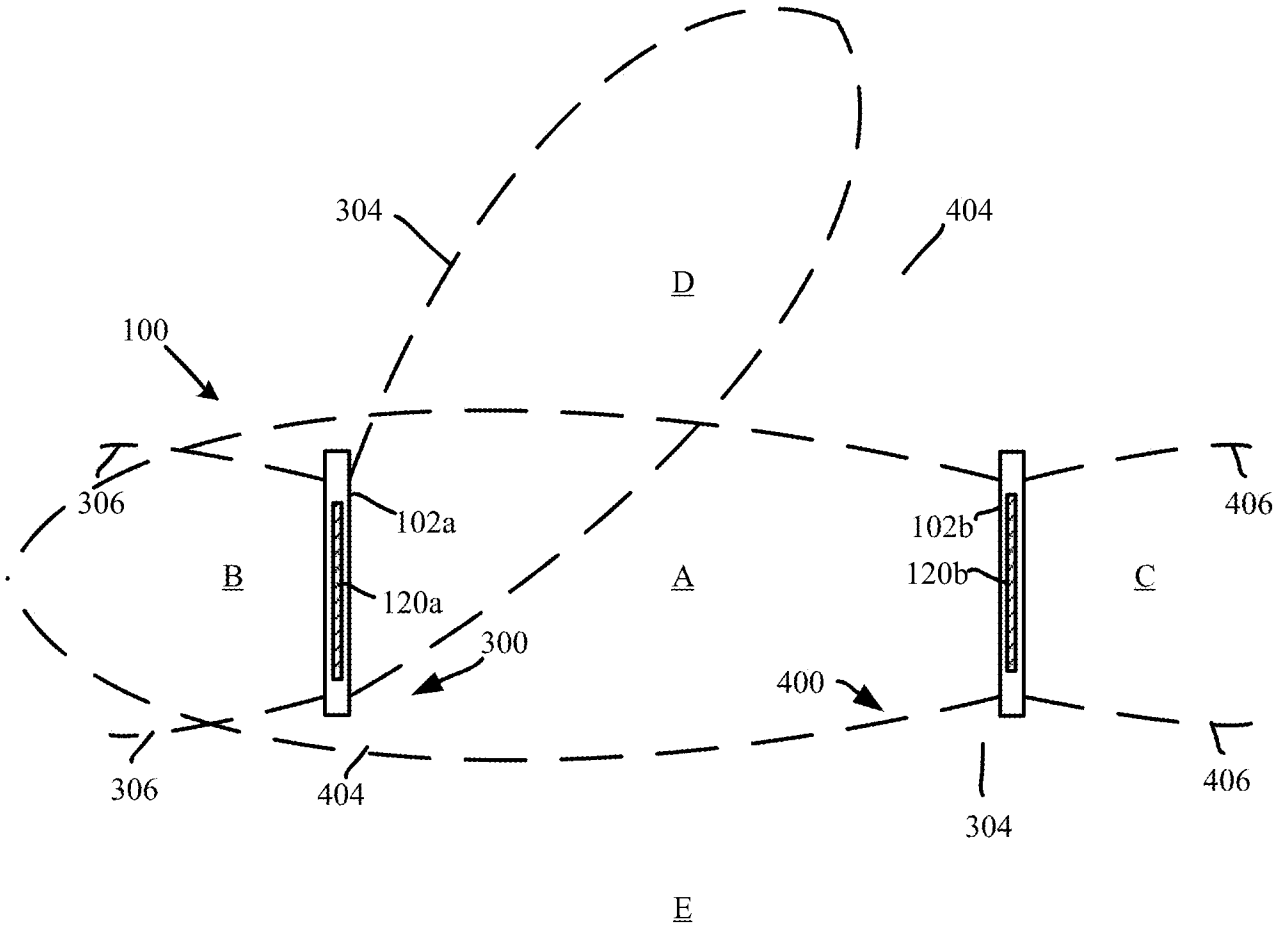

The cameras provide an RFID reader or system controller 110 with real-time contextual information about the presence of people/packages/objects, the location of the same, and a direction of travel of the same. In the case that a person is detected by a camera, the camera can also provide real-time contextual information about whether or not the person is carrying any items. The real-time contextual information is then used by the RFID reader or system controller 110 to determine when and where to steer a read beam, and also provide better false positive results on theft detection. For example, read beams can be steered so that main lobes 304, 404 point in the direction of area A as shown in FIG. 5, area D as shown in FIG. 6, or area E as shown in FIG. 7. The present solution is not limited to the particulars of this example. The two read beams can be controlled so that they point in the same direction as shown in FIGS. 5-7 or different directions as shown in FIG. 8. In this way, the RFID reader or system controller 110 integrates real-time knowledge of a surrounding environment to tailor read zones and timing instead of just blindly spending a fixed fraction of time in each zone.

It should be noted that the two pedestals 102*a*, 102*b* can be activated at the same time or in a multiplexed manner. In the multiplexed scenarios, the pedestals 102*a*, 102*b* are activated in an alternating manner. For example, at a first time, pedestal 102*a* is activated and pedestal 102*b* is deactivated. At a second time, pedestal 102*a* is deactivated and pedestal 102*b* is activated.

FIG. 6 shows a scenario where a person 600 is walking past the pedestals 120*a*, 120*b* in a direction 602, a person 604 is exiting a facility in a direction 606, and a person 608 is entering a facility in a direction 610. The read beams of the pedestals 120*a*, 120*b* are pointed in directions towards area or zone D (e.g., an area or zone inside the facility) based on contextual information received from one or more cameras 108*a*-108*h* (not shown in FIGS. 5-8 for simplicity of illustration). In this case, RFID tag reads associated with person 600 and person 608 are ignored. However, an RFID tag read associated with person 604 is analyzed to determine if an alarm should be issued.

Figure 9A:
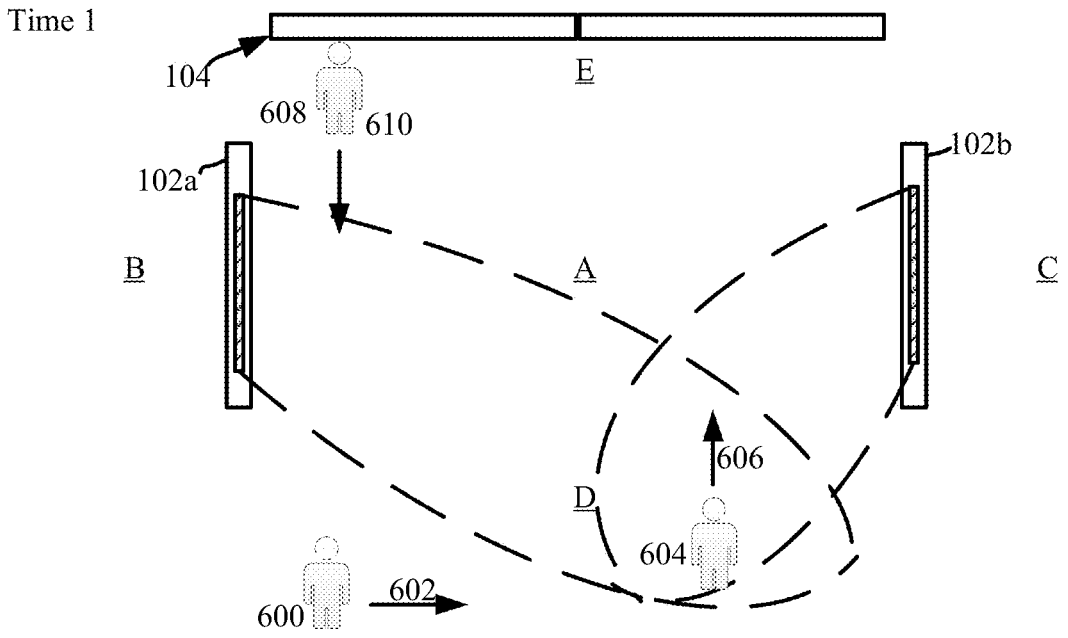
FIGS. 9A-9C (collectively referred to herein as "FIG. 9") provide drawings that are useful for understanding how a person can be tracked in a plurality of zones by the system of FIG. 1 using RFID read information.
Figure 9B:
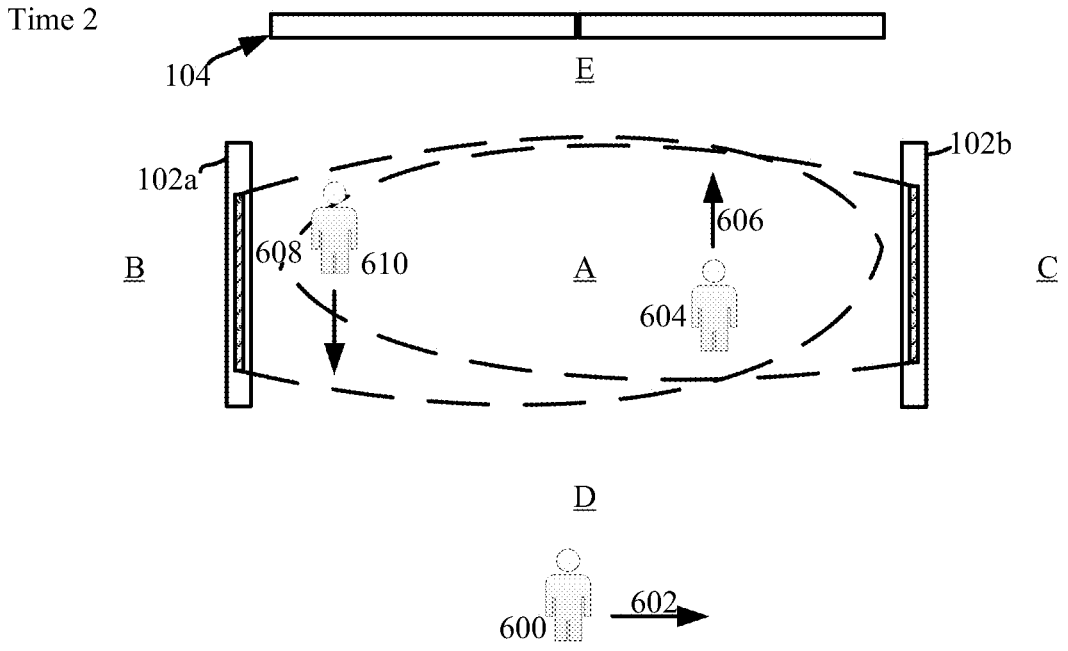
Figure 9C:
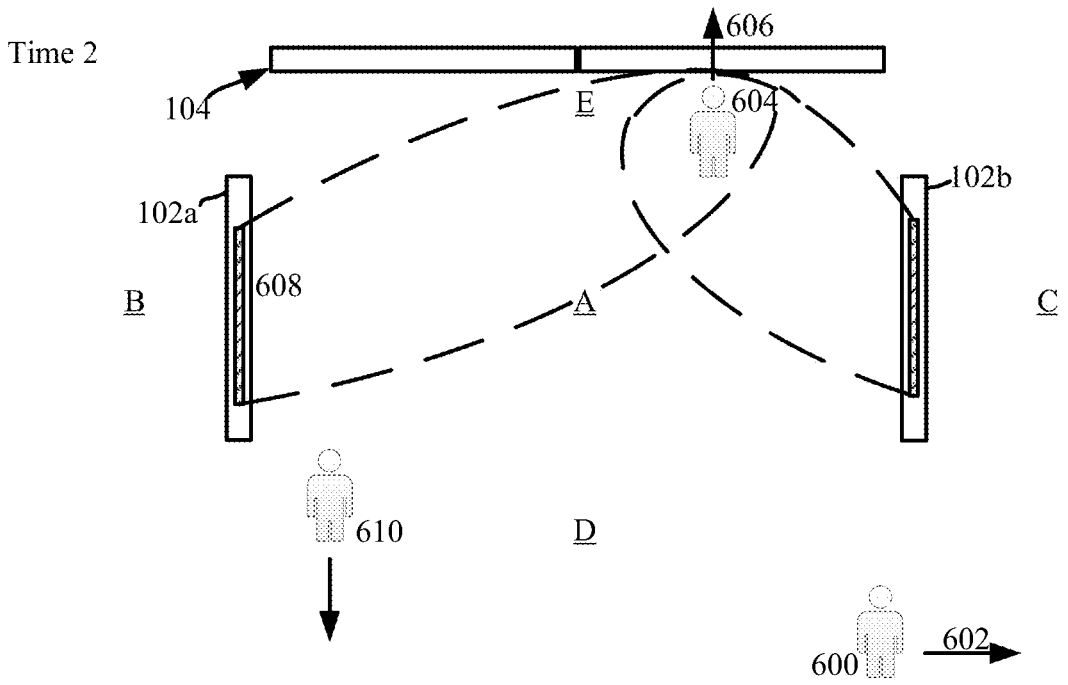

As shown in FIGS. 9A-9C, person 604 can be tracked in zones D, A and E by system 100 using RFID tag read information. This tracking feature of the present solution is facilitated by beam steering using contextual information for a surrounding environment collected by one or more cameras.

The present solution has many advantages. In this regard, it should be appreciated that the present solution provides an improved (e.g., two to three times better) read rate by concentrating the read beams where people/packages/objects are located and when the same is exiting a facility (e.g., a retail store). No RF or power is used by the pedestals when there are no people/packages/objects moving towards the same. The present solution provides a vastly reduced number of false positives for RFID exiting reads since: an RFID read occurs only when a person/package/object is exiting the facility; RFID reads are ignored when no peson/package/object is exiting the facility; RFID reads are ignored when a peson/package/object is walking past the pedestals in an X direction; RFID reads are ignored when one or more people/packages/objects are entering the facility; and/or monitored door motion is used to tailor read timing and zone coverage. The present solution also facilitates improved reads for inventory by detecting carts and boxes for additional read times. Antennas or readers on opposite sides of the pedestal can look at people blocking other people from attempting to optimize reading from both sides.

Figure 10:
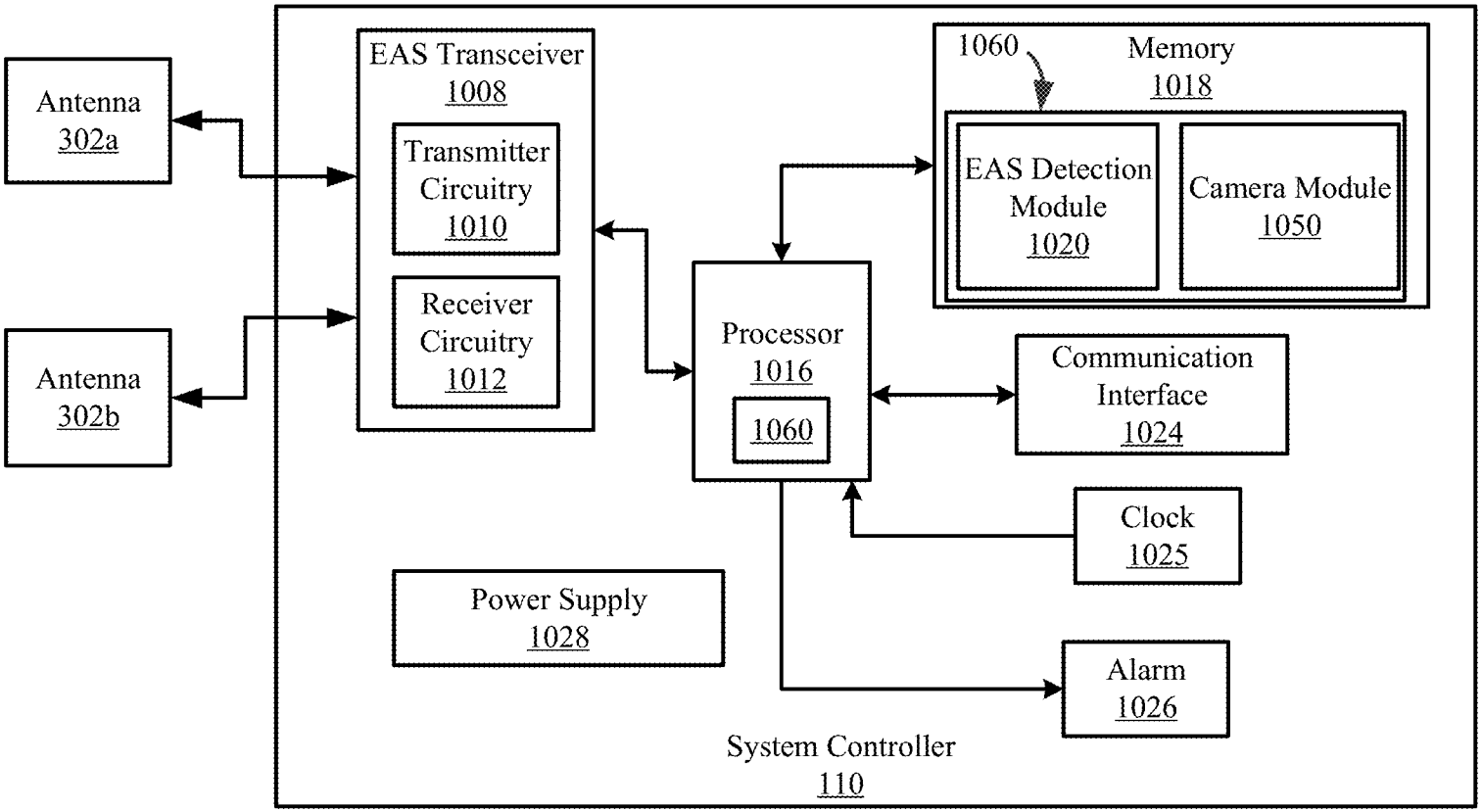
FIG. 10 is a block diagram of the system controller shown in FIGS. 1-2.

Referring now to FIG. 10, there is provided a block diagram that is useful for understanding the arrangement of the system controller 110. The system controller comprises a processor 1016 (such as a micro-controller or Central Processing Unit ("CPU")). The system controller also includes a computer readable storage medium, such as memory 1018 on which is stored one or more sets of instructions 1060 (e.g., software code) configured to implement one or more of the methodologies, procedures or functions described herein. The instructions 1060 (i.e., computer software) can include an EAS detection module 1020 to facilitate EAS detection and perform methods for selectively issuing an alarm based on a detected location of an EAS security tag, as described herein. The instructions can also include a camera module 1050 to (a) cause images/videos to be captured by at least one camera coupled to a pedestal, (b) cause the images/videos to be communicated from the camera to the system controller 110, (c) metadata to be communicated from the camera to the system controller 110, (d) process images, videos and/or metadata to determine a read beam pointing direction, and/or (e) provide the read beam pointing direction to the processor 1016 for use in controlling antennas 30*a*, 302*b*. These instructions 1060 can also reside, completely or at least partially, within the processor 1016 during execution thereof.

The system also includes at least one EAS transceiver 1008, including transmitter circuitry 1010 and receiver circuitry 1012. The transmitter and receiver circuitry are electrically coupled to antenna 302*a* and the antenna 302*b*. A suitable multiplexing arrangement can be provided to facilitate both receive and transmit operation using a single antenna (e.g., antenna 302*a* or 302*b*). Transmit operations can occur concurrently at antennas 302*a*, 302*b* after which receive operations can occur concurrently at each antenna to listen for marker tags which have been excited. Alternatively, transmit operations can be selectively controlled as described herein so that only one antenna is active at a time for transmitting interrogation signals. The antennas 302*a*, 302*b* can include an upper and lower antenna similar to those shown and described with respect to FIG. 1. Input signals applied to the upper and lower antennas can be controlled by transmitter circuitry 1010 or processor 1016 so that the upper and lower antennas operate in a phase aiding or a phase opposed configuration as required.

Additional components of the system controller 110 can include a communication interface 1024 configured to facilitate wired and/or wireless communications from the system controller 110 to a remotely located EAS system server. The system controller can also include a real-time clock 1025 which is used for timing purposes, and an alarm 1026 (e.g., an audible alarm, a visual alarm, or both) which can be activated when an active EAS security tag is detected within the EAS detection zone (e.g., zone 150 of FIG. 1, zone A, zone D, zone E of FIGS. 5-8). A power supply 1028 provides necessary electrical power to the various components of the system controller 110. The electrical connections from the power supply to the various system components are omitted in FIG. 10 so as to avoid obscuring the present solution.

Those skilled in the art will appreciate that the system controller architecture illustrated in FIG. 10 represents one possible example of a system architecture that can be used with the present solution. However, the present solution is not limited in this regard and any other suitable architecture can be used in each case without limitation. Dedicated hardware implementations including, but not limited to, application-specific integrated circuits, programmable logic arrays, and other hardware devices can likewise be constructed to implement the methods described herein. It will be appreciated that the apparatus and systems of various inventive embodiments broadly include a variety of electronic and computer systems. Some embodiments may implement functions in two or more specific interconnected hardware modules or devices with related control and data signals communicated between and through the modules, or as portions of an application-specific integrated circuit. Thus, the illustrative system is applicable to software, firmware, and hardware implementations.

Figure 11A:
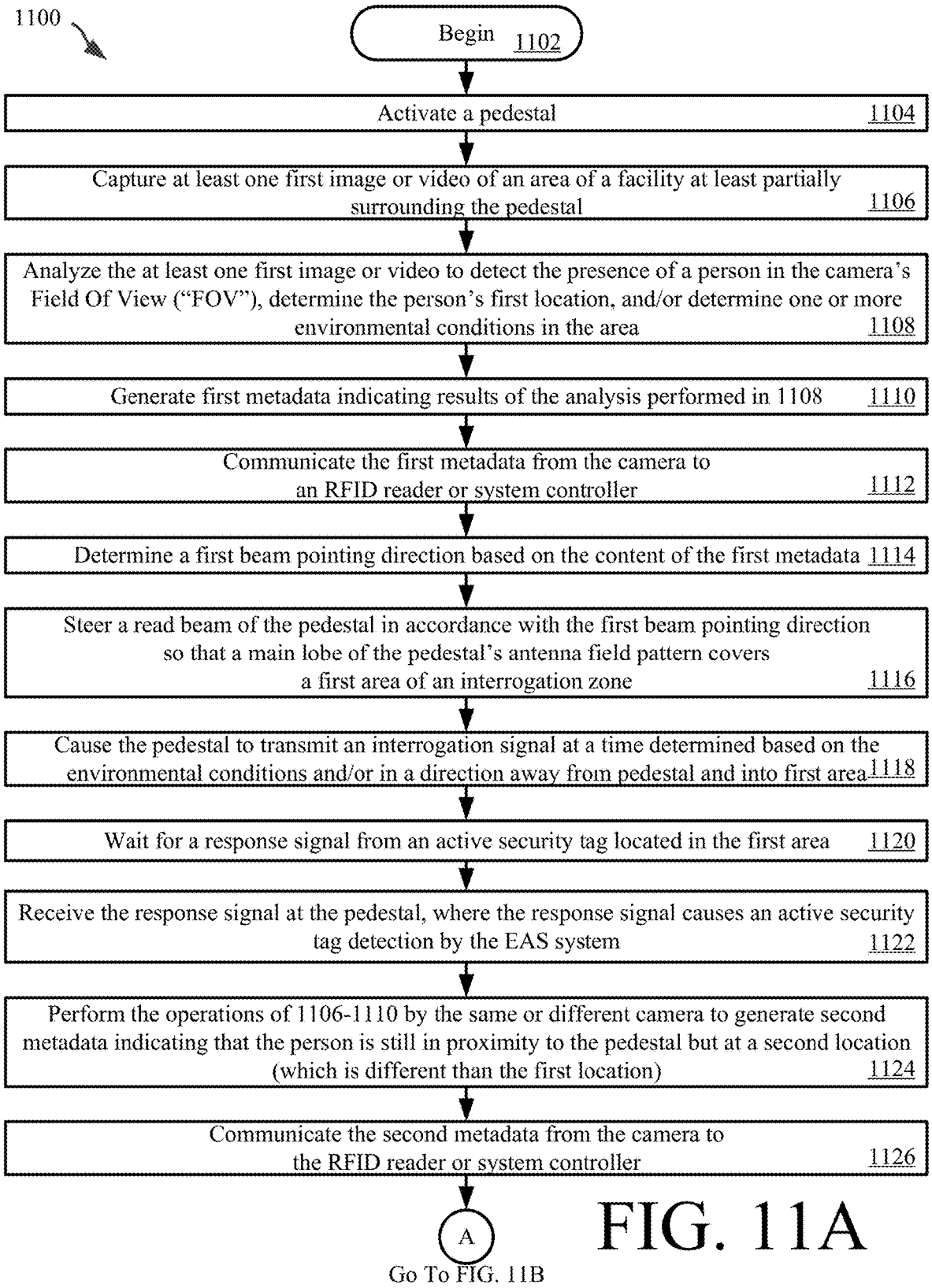
FIGS. 11A-11B (collectively referred to as "FIG. 11") is a flowchart of an illustrative method for operating a pedestal of an EAS system.

Referring now to FIG. 11, there is provided a flow diagram of an illustrative method 1100 for operating a pedestal (e.g., pedestal 102*a* or 102*b* of FIG. 1) of an EAS system (e.g., EAS system 100 of FIG. 1). As shown in FIG. 11A, method 1100 begins with 1102 and continues with 1104 where the pedestal is activated. Next in 1106, at least one camera (e.g., camera 108*a*, 108*b*, 108*c*, 108*d*, 108*e*, 108*f*, 108*g*, and/or 108*h* of FIGS. 1-1) captures one or more first images or videos showing a scene in an area of a facility (e.g., area A, B, C, D or E of FIG. 5). The area at least partially surrounds the pedestal. The first image(s)/video(s) is(are) analyzed in 1108 to detect the presence of a person (e.g., person 604 of FIG. 6) in the camera's Field Of View ("FOV"), determine the person's first location, and/or determine one or more environmental conditions in the area. The environmental condition can include, but is not limited to, motion of a door (e.g., door 104 of FIG. 1). First metadata is generated in 1110 that indicates the results of the analysis performed in 1108. The first metadata is then communicated from the camera to an RFID reader or system controller (e.g., system controller 110 of FIG. 1) as shown by 1112. The present solution is not limited in this regard. The first image(s)/video(s) could additionally or alternatively be analyzed by the RFID reader or system controller.

At the RFID reader or system controller, a first beam pointing direction is determined in 1114 based on the content of the metadata. In 1116, a read beam of the pedestal is steered in accordance with the first beam pointing direction so that a main lobe (e.g., main lobe 304 or 404 of FIGS. 3-4) of the pedestal's antenna field pattern covers a first area (e.g., area D of FIG. 9A) in an interrogation zone (e.g., interrogation zone 150 of FIGS. 2 and 5).

Next in 1118-1122, tag detection operations are performed. The tag detection operations involve: performing operations by a system controller (e.g., system controller 110 of FIG. 1) to cause the first pedestal to transmit an interrogation signal at a time determined based on the environmental conditions (e.g., door opening or closing) and/or in a direction away from the first pedestal and into the first area; waiting for a response signal from an active security tag (e.g., security tag 112 of FIG. 2) located in the first area of the interrogation zone (e.g., interrogation zone 150 of FIG. 2); and receiving the response signal at the first pedestal. Notably, the response signal is strong enough to cause the EAS system (e.g., EAS system 100 and/or system controller 110 of FIG. 1) to detect an active security tag located in the first area.

Upon completing 1122, 1124 is performed where the same or different camera generates second metadata indicating that the person is still in proximity to the pedestal but at a second location which is different from the first location. The second metadata is communicated from the camera to the RFID reader or system controller in 1126. Subsequently, method 1100 continues with 1128 of FIG. 11B. The present solution is not limited in this regard. Additionally or alternatively, the second metadata can be generated by the RFID reader or system controller.

Figure 11B:
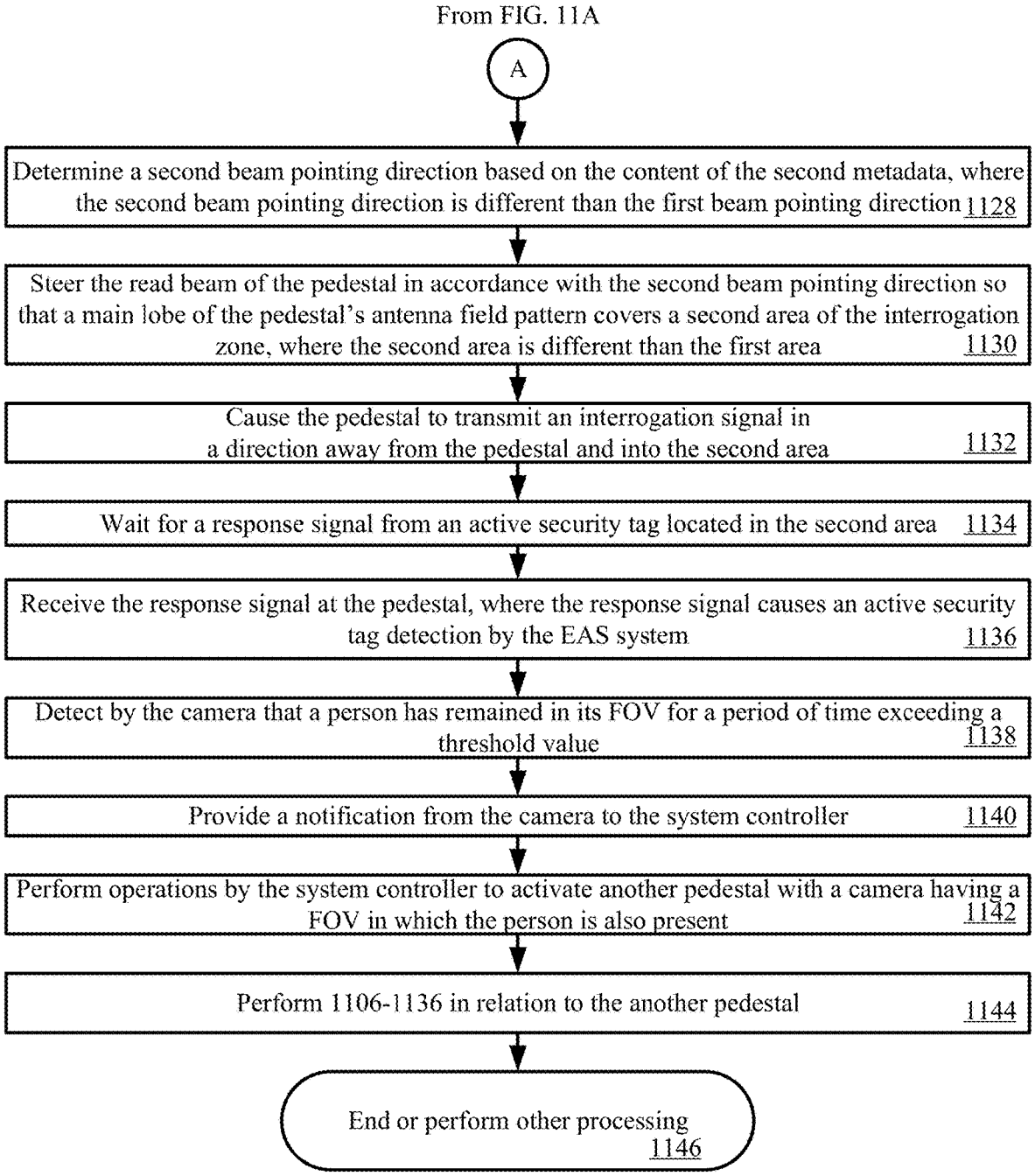

As shown in FIG. 11B, 1128 involves determining a second beam pointing direction based on the content of the second metadata. This determination may be made by the RFID reader or system controller. The second beam pointing direction is different than the first beam pointing direction. The read beam is steered in 1130. More specifically, the read beam is steered in accordance with the second beam pointing direction so that the main lobe of the pedestal's antenna field pattern covers a second area of the interrogation zone (e.g., area A in FIG. 9B or E in FIG. 9C). The second area is different than the first area. Techniques for steering beams are well known in the art, and therefore will not be described here. Any known or to be known beam steering technique can be used herein without limitation. The pedestal is then caused by the RFID reader or system controller to transmit an interrogation signal in a direction away from the pedestal and into the second area, as shown by 1132. The pedestal then waits in 1134 for a response signal from an active security tag located in the second area. In 1136, the response signal is received at the pedestal. The response signal causes an active security tag detection by the EAS system (e.g., EAS system 100 of FIG. 1).

In some scenarios, the cameras provide blocked sensor alerts as shown by 1138-1144. 1138-1144 involve: detecting by the camera that a person has remained in its FOV for a period of time exceeding a threshold value; providing a notification from the camera to the system controller of the person's dwelling in its FOV; performing operations by the system controller to activate another pedestal with a camera having a FOV in which the person is also present; and performing 1106-1136 for the another pedestal. Subsequently, 1146 is performed where method 1100 ends or other processing is performed.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for operating a pedestal of an Electronic Article Surveillance ("EAS") system, comprising:

capturing at least one first image or video by a camera coupled to the pedestal;

analyzing the at least one first image or video to detect a presence of a person and determine a location of the detected person relative to the camera;

determining, by a system controller of the EAS system for the pedestal, a first beam pointing direction for an antenna of the pedestal based on the determined location of the person detected as present; and steering, by the system controller, a read beam of the antenna in accordance with the first beam pointing direction so that a main lobe of a field pattern of the antenna covers a first area of an interrogation zone including the determined location.

2. The method according to claim 1, further comprising causing the pedestal to transmit an interrogation signal in a direction away from the pedestal and into the first area.

3. The method according to claim 1, further comprising receiving, by the pedestal, a response signal that causes an active security tag detection by the EAS system.

4. The method according to claim 1, wherein the analyzing further involves determining environmental conditions in an area of a facility at least partially surrounding the pedestal.

5. The method according to claim 4, further comprising causing the pedestal to transmit an interrogation signal into the first area and at a time determined based on the environmental conditions.

6. The method according to claim 5, wherein the environmental condition comprises door movement.

7. The method according to claim 1, further comprising:

capturing at least one second image or video by the camera or another camera coupled to the pedestal;

analyzing the at least one second image or video to second detect a presence of the person and second determine a second location of the second detected person relative to the camera or another camera;

determining a second beam pointing direction for the antenna based on the second determined location of the person second detected as present, where the second beam pointing direction is different than the first beam pointing direction; and steering the read beam of the antenna in accordance with the second beam pointing direction so that the main lobe of the field pattern of the antenna covers a second area different than the first area of the interrogation zone including the second determined location.

8. The method according to claim 1, further comprising:

determining a second beam pointing direction for the pedestal based on content of at least one first image or video;

re-steering the read beam of the pedestal in accordance with the second beam pointing direction so that the main lobe of the pedestal's antenna field pattern covers a second area of an interrogation zone.

9. The method according to claim 1, further comprising:

using camera data to track movement of the person; and dynamically steering the read beam to follow the person through the interrogation zone.

10. The method according to claim 1, wherein the camera is embedded into an antenna or the pedestal.

11. An electronic article surveillance (EAS) system, comprising:

a pedestal;

a camera coupled to the pedestal and configured to capture at least one first image or video, and to analyze the at least one first image or video to detect presence of a person and determine a location of the detected person relative to the camera; and a system controller communicatively connected to the pedestal and the camera, the system controller comprising a processor, and a non-transitory computer-readable storage medium comprising programming instructions that are configured to cause the processor to:

determine a first beam pointing direction for an antenna of the pedestal based on the determined location of the person detected as present; and cause a read beam of antenna to be steered in accordance with the first beam pointing direction so that a main lobe of a field pattern of the antenna covers a first area of an interrogation zone including the determined location.

12. The system according to claim 11, wherein the pedestal is caused to transmit an interrogation signal in a direction away from the pedestal and into the first area.

13. The system according to claim 11, wherein the pedestal receives a response signal that causes an active security tag detection by the EAS system.

14. The system according to claim 11, wherein the analysis of the at least one first image or video comprises determining environmental conditions in an area of a facility at least partially surrounding the pedestal.

15. The system according to claim 14, wherein the pedestal is caused to transmit an interrogation signal into the first area and at a time determined based on the environmental conditions.

16. The system according to claim 15, wherein the environmental condition comprises door movement.

17. The system according to claim 11, wherein:

the camera or another camera coupled to the pedestal captures at least one second image or video; and the programming instructions further cause the processor to:

analyzes the at least one second image or video to second detect a presence of the person and second determine a second location of the second detected person relative to the camera or another camera;

determine a second beam pointing direction for the antenna based on the second determined location of the person second detected as present, where the second beam pointing direction is different than the first beam pointing direction; and cause the read beam of the antenna to be steered in accordance with the second beam pointing direction so that the main lobe of the field pattern of the antenna covers a second area different than the first area of the interrogation zone including the second location.

18. The system according to claim 11, wherein the programming instructions further cause the processor to:

determine a second beam pointing direction for the pedestal based on content of at least one first image or video;

cause the read beam of the pedestal to be re-steered in accordance with the second beam pointing direction so that the main lobe of the pedestal's antenna field pattern covers a second area of an interrogation zone.

19. The system according to claim 11, wherein the programming instructions further cause the processor to:

use camera data to track movement of the person; and cause the read beam to be dynamically steered to follow the person through the interrogation zone.

20. The system according to claim 11, wherein the camera is embedded into an antenna or the pedestal.

* * * * *